US010524533B2

(12) United States Patent
Knoll

(10) Patent No.: US 10,524,533 B2
(45) Date of Patent: Jan. 7, 2020

(54) ROLLER SKATE SYSTEM HAVING A RAIL AND A BOOT

(71) Applicant: Powerslide GmbH, Bindlach (DE)

(72) Inventor: Matthias Knoll, Bindlach (DE)

(73) Assignee: Powerslide GmbH, Bindlach (DE)

( * ) Notice: Subject to any disclaimer, the term of this patent is extended or adjusted under 35 U.S.C. 154(b) by 0 days.

(21) Appl. No.: 15/656,682

(22) Filed: Jul. 21, 2017

(65) Prior Publication Data

US 2017/0318897 A1 Nov. 9, 2017

Related U.S. Application Data

(63) Continuation of application No. PCT/EP2016/051519, filed on Jan. 26, 2016.

(30) Foreign Application Priority Data

Jan. 28, 2015 (DE) ..... 10 2015 001 034
Jan. 28, 2015 (DE) ..... 20 2015 000 618 U

(51) Int. Cl.
*A63C 17/06* (2006.01)
*A43B 5/16* (2006.01)

(52) U.S. Cl.
CPC ..... *A43B 5/1641* (2013.01); *A43B 5/1616* (2013.01); *A63C 17/06* (2013.01)

(58) Field of Classification Search
CPC ..... A63C 17/06; A63C 17/045; A63C 17/017; A63C 17/016; A63C 17/015; A63C 1/22; A63C 1/00; A43B 5/1641
See application file for complete search history.

(56) References Cited

U.S. PATENT DOCUMENTS 1,984,989 A * 12/1934 Reed ..... A43B 5/12 36/113
3,866,339 A * 2/1975 Latto ..... A43B 5/18 36/100

(Continued)

FOREIGN PATENT DOCUMENTS

CN 1128499 A 8/1996
DE 69419612 T2 5/2000

(Continued)

OTHER PUBLICATIONS

Examination report by the German Patent and Trademark Office (DPMA) in application DE 10 2015 001 034.4, from which this application claims priority, dated Sep. 29, 2015.

(Continued)

*Primary Examiner* — John D Walters
*Assistant Examiner* — James J Triggs
(74) *Attorney, Agent, or Firm* — Falk Ewers; Ewers IP Law PLLC

(57) ABSTRACT

A boot for a roller skate system has a three-point fastening system for fastening the boot to a rail. The three-point fastening system includes three fastening devices, wherein the first fastening device is arranged in a central position in the heel region of the boot, the second fastening device is arranged on an outer side in the ball region of the boot, and the third fastening device is arranged on an inner side in the ball region of the boot. The rail that can be mounted on the boot is also described.

15 Claims, 7 Drawing Sheets

(56) References Cited

U.S. PATENT DOCUMENTS 4,538,480 A * 9/1985 Trindle ..... A43B 5/14 24/697.1
5,125,173 A * 6/1992 Nagano ..... A43B 5/14 36/131
5,437,466 A * 8/1995 Meibock ..... A43B 5/0401 280/11.202
5,452,907 A * 9/1995 Meibock ..... A43B 5/0401 280/11.231
5,524,913 A * 6/1996 Kulbeck ..... A63C 17/06 280/11.208
5,549,310 A * 8/1996 Meibock ..... A43B 5/0401 280/11.221
5,645,287 A * 7/1997 Soo ..... A63C 17/06 280/11.216
5,662,338 A * 9/1997 Steinhauser, Jr. ..... A63C 17/18 280/11.27
5,738,360 A * 4/1998 Petell ..... A63C 17/006 280/11.222
5,752,708 A * 5/1998 Svensson ..... A63C 17/068 280/11.231
6,113,123 A * 9/2000 Cabanis ..... A43B 5/1625 280/11.3
6,189,913 B1 * 2/2001 Morrow ..... A43B 5/0401 280/14.21
6,334,621 B1 * 1/2002 Chang ..... A63C 1/04 280/11.221
D484,558 S * 12/2003 Lo ..... D21/764
6,883,812 B1 * 4/2005 Hsieh ..... A63C 17/0086 280/11.16
2002/0105150 A1 * 8/2002 Liao ..... A63C 17/0046 280/11.223
2002/0163147 A1 * 11/2002 Svensson ..... A63C 1/28 280/11.231
2007/0063458 A1 3/2007 Bont
2011/0187066 A1 * 8/2011 Lin ..... A63C 17/06 280/11.26
2015/0305447 A1 * 10/2015 Cavaliere ..... A43C 15/161 36/66

FOREIGN PATENT DOCUMENTS

DE 69717250 T2 4/2003
DE 202012104957 U1 3/2013
EP 1767253 A2 3/2007
FR 2767651 A1 3/1999
WO 1995003101 A1 2/1995
WO 2011162870 A2 12/2011

OTHER PUBLICATIONS

Examination report by the German Patent and Trademark Office (DPMA) in application DE 10 2015 001 034.4, from which this application claims priority, dated Jan. 13, 2016.
International Search report of PCT/EP2016/051519 for which this application claims priority, dated Apr. 28, 2016 and English-language translation thereof.
International Preliminary Report on Patentability of PCT/EP2016/051519 from which this application claims priority, dated Aug. 10, 2017, and English-language translation thereof.
Office action by the Chinese Patent Office (SIPO) dated Mar. 29, 2019 in CN 201680006695.1, which is a counterpart hereof, and English-language translation thereof.

* cited by examiner

ROLLER SKATE SYSTEM HAVING A RAIL AND A BOOT

CROSS REFERENCE TO RELATED APPLICATIONS

This application is a continuation application of International Application No. PCT/EP2016/051519 filed on Jan. 26, 2016, and claims priority to German patent applications DE 10 2015 001 034.4 filed on Jan. 28, 2015 and DE 20 2015 000 618.3 filed on Jan. 28, 2015, all of which are hereby incorporated by reference in their entireties.

TECHNICAL FIELD

The present disclosure relates to a roller skate system, a boot for the roller skate system, and a rail for the roller skate system.

BACKGROUND

In many roller skate systems the boots are connected to a rail only via two relatively small contact surfaces, which are disposed one behind the other. If one of the two mounting screws comes loose the skater may fall. In addition, the changing of individual components, such as the boot or the rail for example, can often only be carried out by a specialist dealer for relatively high cost. The higher the centre of gravity of these roller skate systems, the more static effort is required of a skater. In the case of mounting points which lie one behind another, the roller skate system tilts slightly under laterally acting forces.

US 2007/0063458 A1 relates, for example, to an in-line skate with a rail and a boot. The boot and the rail have three mounting points disposed one behind another in a line.

SUMMARY

An object of the present disclosure is to improve a roller skate system in such a way that the system has more stability and permits an improved transmission of forces. In addition, quicker and easier changing of a rail or of a boot should be possible.

According to a first aspect, this object is achieved by a boot for a roller skate system having a three-point fastening system for fastening the boot to a rail, wherein the system comprises three fastening devices, wherein the first fastening device is disposed in a middle in the heel region of the boot; the second fastening device is disposed on an outer side in the ball region of the boot; and the third fastening device is disposed on an inner side in the ball region of the boot. In this way, for example, the technical advantage is achieved that a triangular connection between the boot and rail is produced. By reasons of the additional mounting point, geometrical arrangement, and enlarged overall contact surface, the triangular connection offers a strong and stable connection between the boot and the rail for improved transmission of forces during skating.

In one exemplary embodiment of the boot, the second fastening device is disposed in the longitudinal direction of the boot offset with respect to the third fastening device. In this way, for example, the technical advantage is achieved that transmission of forces is improved further.

In one further exemplary embodiment of the boot, the second fastening device is disposed in the longitudinal direction of the boot offset towards the first fastening device.

In this way, for example, the technical advantage is likewise achieved that transmission of forces is improved further.

In a further exemplary embodiment of the boot, the first fastening device, the second fastening device or the third fastening device comprises an opening with an elongate cross-section for displacement of an inserted fastening screw. In this way, for example, the technical advantage is achieved that the roller skate system can be individually adapted to an anatomy or to preferences in skating technique.

In another exemplary embodiment of the boot, the boot has a hard shell in which the fastening devices are formed. In this way, for example, the technical advantage is achieved that overall stability is improved.

In a further exemplary embodiment of the boot, the hard shell includes carbon fibres and/or glass fibres for stiffening purposes. In this way, for example, the technical advantage is achieved that rigidity of the hard shell is improved.

In a further exemplary embodiment of the boot, the fastening devices are formed by openings in a metal plate. In this way, for example, the technical advantage is achieved that the boot can be fastened with a screw connection.

In yet another exemplary embodiment of the boot, the fastening devices are surrounded by a planar contact surface. In this way, for example, the technical advantage is achieved that transmission of forces and the stability are improved.

According to a second aspect of the disclosure, this object is achieved by a rail for a roller skate system having a channel to receive a plurality of wheels disposed one behind another and a three-point fastening system for fastening the rail to a boot, wherein the system includes three fastening devices, wherein the first fastening device is disposed above the middle of the channel; the second fastening device is disposed laterally offset with respect to one side of the channel; and the third fastening device is disposed laterally offset with respect to the other side of the channel. In this way, for example, the technical advantage is also achieved that a stable triangular connection between the boot and rail is produced.

In one exemplary embodiment of the rail, the second fastening device and/or the third fastening device are disposed on a wing portion protruding laterally with respect to the channel. In this way, for example, the technical advantage is achieved that a large spacing can be achieved between the two fastening devices.

In a further exemplary embodiment of the rail, the wing portions are connected to one another right across the channel. In this way, for example, the technical advantage is achieved that the stability of the rail is improved.

In another exemplary embodiment of the rail, the wing portions are trapezoidal, rectangular or semi-circular. In this way, for example, the technical advantage is achieved that the wing portions are produced without sharp corners and there is a reduced risk of injury.

In yet another exemplary embodiment of the rail, the second fastening device is disposed in the longitudinal direction of the channel offset with respect to the third fastening device. In this way, for example, the technical advantage is achieved that a transmission of forces is improved with a correspondingly designed boot.

In a further exemplary embodiment of the rail, the first fastening device, the second fastening device and/or the third fastening device comprises an opening with an elongate cross-section for displacement of an inserted fastening screw. In this way, for example, the technical advantage is achieved that the roller skate system can be individually adapted to an anatomy or to preferences in skating technique.

According to a third aspect, this object is achieved by a roller skate system with a boot according to the first aspect; and a rail according to the second aspect. In this way, the same technical advantages are achieved as by the boot and the rail.

Exemplified embodiments of the disclosure are illustrated in the drawings and are described in more detail hereinunder.

BRIEF DESCRIPTION OF THE DRAWINGS

Below, exemplary embodiments of the disclosure, which are schematically depicted in the drawings, are described, wherein.

DESCRIPTION OF EXEMPLARY EMBODIMENTS

Figure 1:
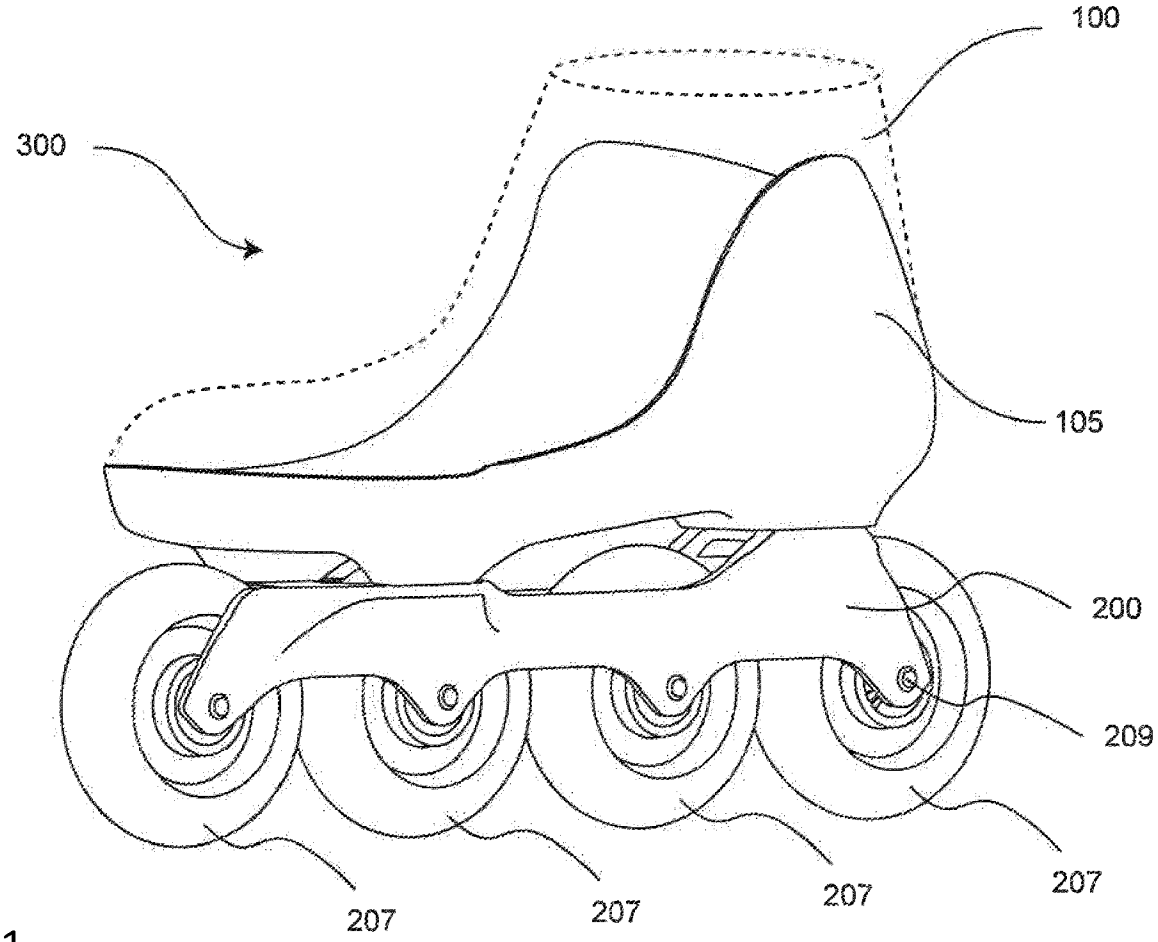
FIG. 1 shows a roller skate system.

FIG. 1 shows a view of an inline skate as roller skate system 300. In the roller skate system 300 the wheels 207 are disposed one behind another in a longitudinal row (inline). With the roller skate system 300 it is possible for a skater to move on wheels. The roller skate system 300 includes a rail 200 and a boot 100 for the skater's foot.

The rail 200 serves to receive the wheels 207 which are fastened to the rail 200 by screws 209. The boot 100 comprises a half-height hard shell 105 which includes, on the underside, a three-point fastening system for fastening the boot 100 to the rail 200. The hard shell 105 laterally supports the foot and the ankle joint. The hard shell 105 can be formed, for example, from a synthetic material into which glass fibres or carbon fibres are embedded for stiffening purposes. In addition, the hard shell 105 can be formed from carbon fibres or glass fibres or a mixture of both types of fibre. The hard shell 105 can generally also be produced on the basis of a synthetic material.

The rail 200 can generally be designed to receive two, three, four or more wheels 207 disposed one behind another. The receiving arrangement for the wheels 207 can lie within one plane or can be rockered so that there is a curved progression (banana shape) along the rail 200. The wheels 207 are fixedly screwed in the rail 200 with a dual axis system or single axis system. The rail 200 can receive, for example, wheels 207 having a diameter of 50 mm to 150 mm. The rail 200 can be produced from an aluminium alloy, magnesium alloy or a carbon fibre-reinforced and/or glass fibre-reinforced synthetic material (carbon or carbon/fibre glass). The rail 200 can also be formed from carbon fibres or glass fibres. The rail 200 can be extruded, cut, cast or stamped. A rail 200 made from carbon fibres or glass fibres can be produced by compression moulding.

The boot 100 can be constructed as a solid hard shell boot with a (removable) inner boot or as a soft-boot in which only the half-height hard shell 105 is produced from solid synthetic material. The boot 100 can be built up on a carbon fibre and/or glass fibre construction, a synthetic material shell or a sole construction without a removable inner boot. The boot 100 and the rail 200 are fixedly connected to one another at three connection points with screws.

Figure 2:
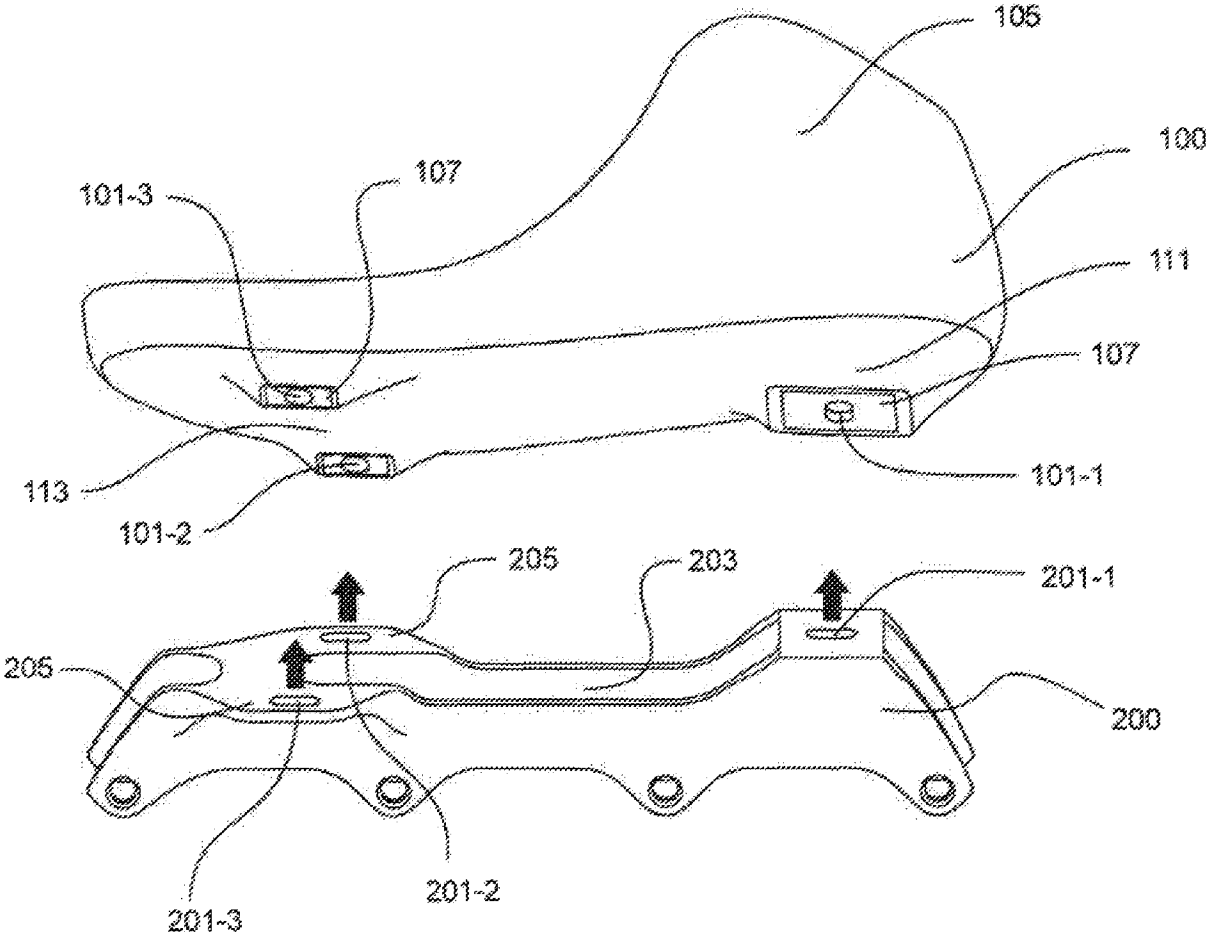
FIG. 2 shows a hard shell with a rail.

FIG. 2 shows a schematic view of the hard shell 105 with a rail 200 in a separated state. The hard shell 105 can be removed in the arrow direction after release of the fastening screws. The hard shell 105 as part of the boot 100 has a three-point fastening system with only three fastening devices 101-1, 101-2, 101-3 for fastening the boot 100 to the rail 200. The three fastening devices 101-1, 101-2, 101-3 of the boot 100 and the three corresponding fastening device 201-1, 201-2, and 201-3 of the rail permit a triangular connection between the boot 100 and rail 200.

The fastening devices 101-1, 101-2, 101-3, 201-1, 201-2, and 201-3 are formed by openings into which fastening screws can be inserted. The fastening devices 101-1, 101-2, and 101-3 can generally also be formed in a different way, such as, for example, by a quick fastener from the inside or outside or a binding system.

The first fastening device 101-1 is disposed centrally in the heel region 111 of the boot 100. The second fastening device 101-2 is laterally offset with respect to the first fastening device 101-1 on a foot outer side in the ball region 113 of the boot 100. The second fastening device 101-2 is in particular offset in the longitudinal direction of the boot 100 towards the first fastening device 101-1 with respect to the third fastening device 101-3.

The third fastening device 101-3 is laterally offset with respect to the first fastening device 101-1 on a foot inner side in the ball region 113 of the boot 100. By reasons of the additional third mounting point, geometrical arrangement, and enlarged overall contact surface, this triangular connection between the boot 100 and rail 200 offers a strong and stable connection between the boot 100 and the rail 200 for improved transmission of forces.

The two front fastening devices 101-2 and 101-3 are disposed asymmetrically offset with respect to one another. Thus, the outer fastening device 101-2 is disposed offset to the rear in the longitudinal direction of the boot 100 towards the first fastening device 101-1. In this way the force transmission is improved further because the outer fastening device 101-2 lies directly below the outer ball of the foot. However, the fastening devices 101-2 and 101-3 can also generally be disposed in a parallel and symmetrical manner. The front fastening devices 101-2 and 101-3 protrude from the sole of the hard shell 105 so that a wheel 207 can be disposed in the space between the fastening devices 101-2 and 101-3. The hard shell 105 has corresponding bulges in particular at the locations of the fastening devices 101-1, 101-2, and 101-3. In particular, the fastening devices 101-1, 101-2, and 101-3 are disposed in these bulges protruding with respect to the rest of the hard shell 105.

The fastening devices 101-1, 101-2, 101-3, 201-1, 201-2, and 201-3 are formed by elongate openings so that inserted fastening screws can be displaced within the openings. Thus, the openings in the boot 100 are formed as transverse slots, whereas the openings in the rail 200 are formed as longitudinal slots. The elongate openings in the boot 100 and the elongate openings in the rail 200 together form a cross so that the boot 100 and the rail 200 can be positioned in two directions with respect to each other. In this way, the roller skate system 300 can be adapted individually to an anatomy or to preferences in skating technique.

The openings in the boot 100 or the openings in the rail 200 can generally be produced either as a round hole or as a longitudinal or transverse slot. The lateral fastening devices 201-2 and 201-3 of the rail 200 are formed on trapezoidal wing portions 205. The rail 200 includes a channel 203 which serves to receive the wheels 207. The wing portions 205 can also generally be in other forms such as for example a rectangle or a semi-circle.

Figure 3:
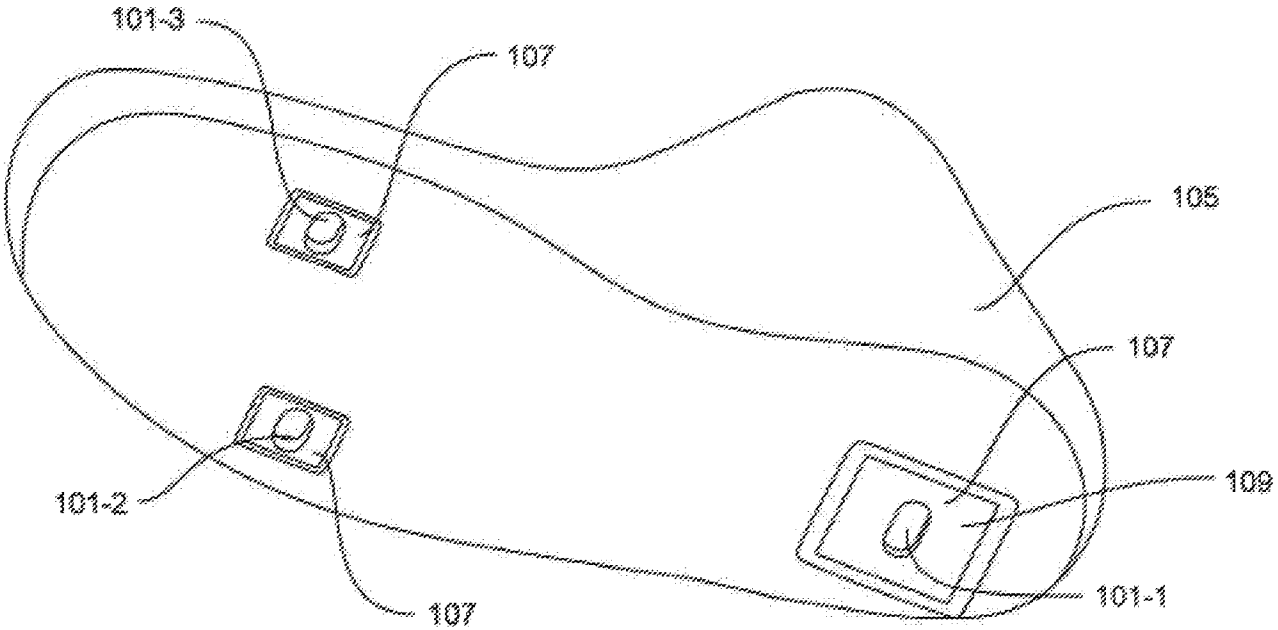
FIG. 3 shows an outer side of the hard shell.

FIG. 3 shows a schematic view of an underside of the hard shell 105. The metal plates 107 with the openings as fastening devices 101-1, 101-2, and 101-3 are let into the hard shell 105 and form a planar contact surface 109 about the openings. The boot 100 and the rail 200 contact the contact surface 109.

Figure 4:
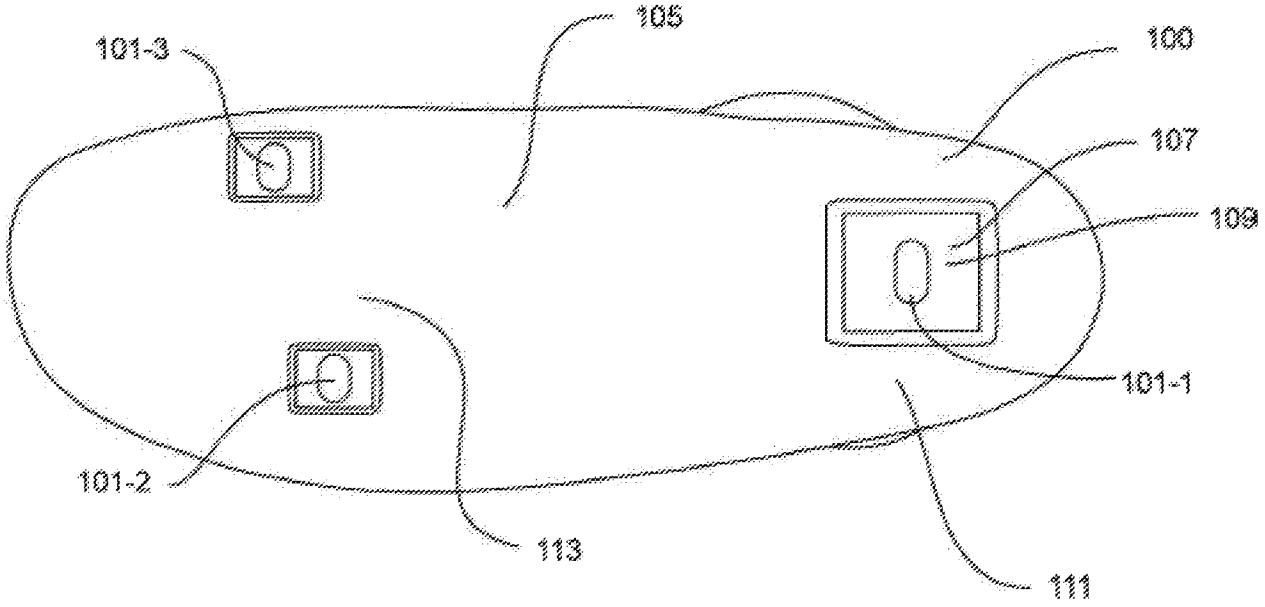
FIG. 4 shows an underside of the hard shell.

FIG. 4 shows a schematic view of an underside of the hard shell 105. The fastening device 101-3 on the inner side of the ball region 113 is further offset towards the toe cap than the fastening device 101-2 on the outer side of the ball region 113. The fastening device 101-1 is located in the heel region 111. In addition, apertures—not illustrated—for the wheels 207 can be formed in the bottom of the hard shell 105 in order to lower the centre of gravity of the roller skate system 300 further. In addition, the sole of the boot 100 can be provided with stiffening elements, which are not illustrated.

The boot 100 with the three-point fastening system allows a user to attach a rail 200 with wheels 207 in the summer or an ice runner, not illustrated, below the boot 100 in the winter. For this purpose, it is not necessary to use a complete system in each case.

Figure 5:
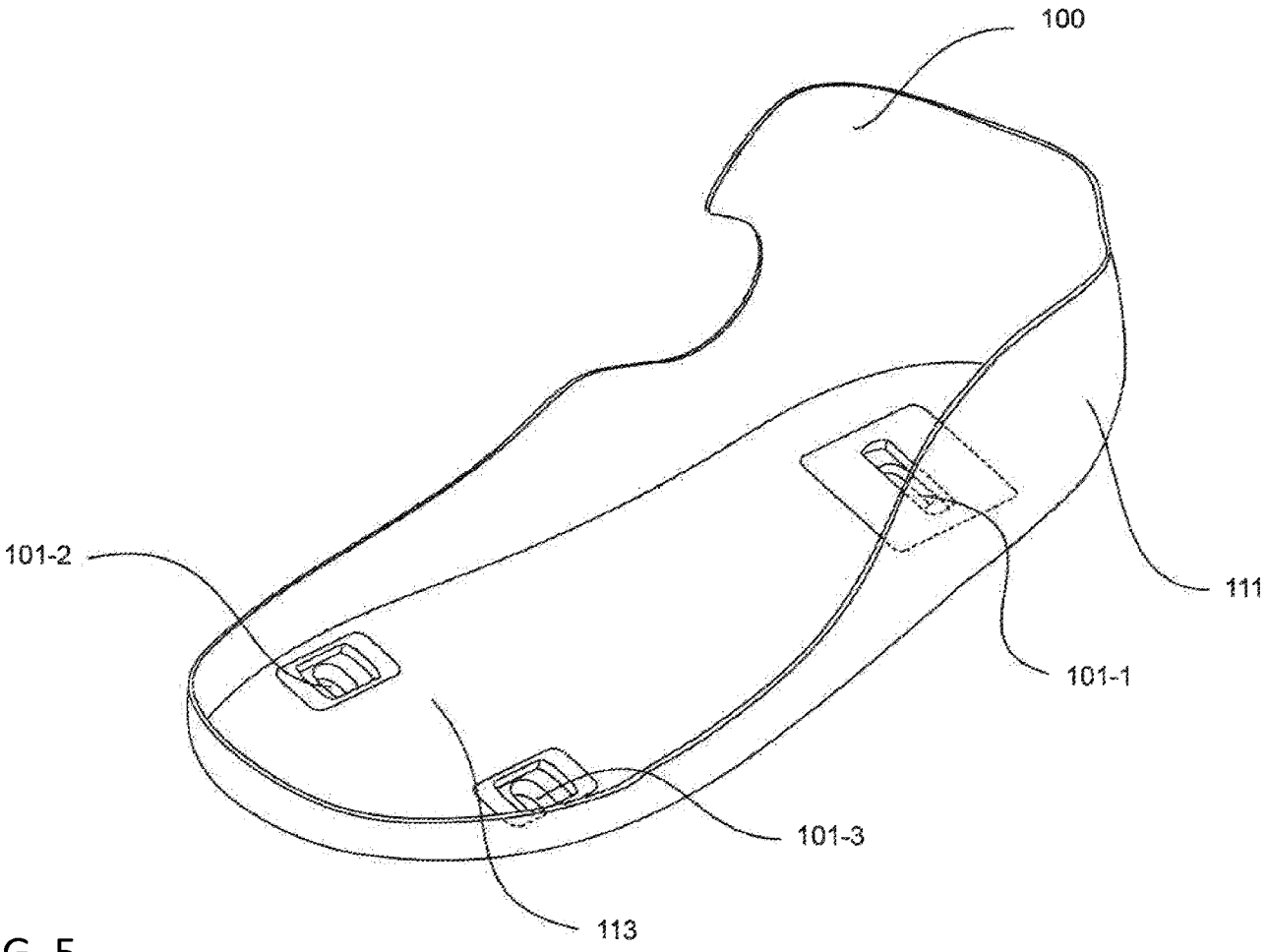
FIG. 5 shows an inner side of the hard shell.

FIG. 5 shows a schematic view of an inner side of the hard shell 105. Threaded bushings, for example, with an internal thread are inserted from above into the openings in the fastening devices 101-1, 101-2, and 101-3 so that the hard shell 105 of the boot 100 can be connected to an external thread by screws which are inserted from below into fastening devices 201-1, 201-2, and 201-3 of the rail 200. It is also generally possible to connect the boot 100 and the rail 200 to one another from above, i.e., from a boot side, for example, in speed skating.

Figure 6:
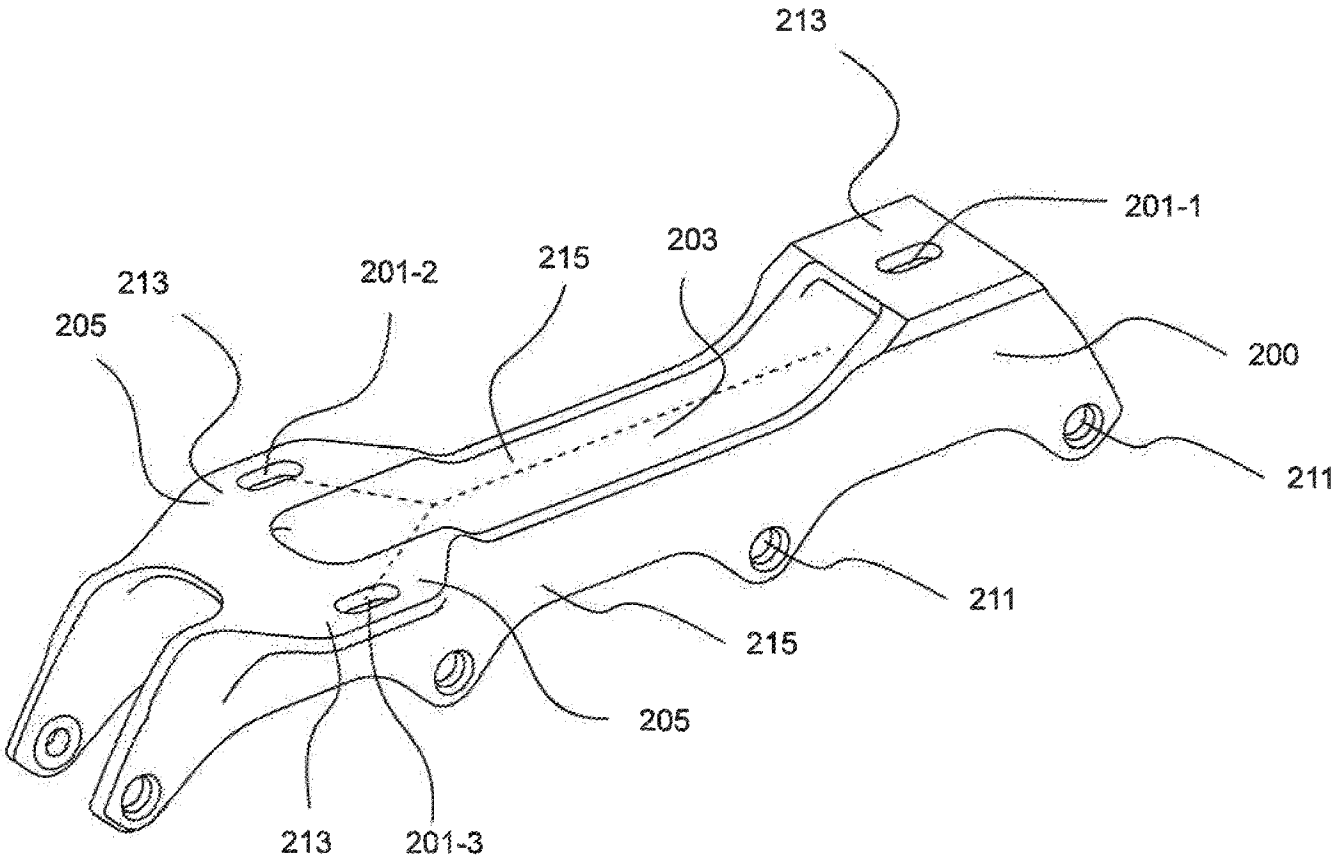
FIG. 6 shows a rail.

FIG. 6 shows a view of the rail 200. The rail 200 also has three mounting points with the fastening devices 201-1, 201-2, and 201-3 which are disposed below the heel and in the front of the foot or ball region of the boot 100. By utilizing the three fastening devices 201-1, 201-2, and 201-3 as mounting points and the corresponding contact surfaces 213 between the boot 100 and the rail 200, the rail 200 offers improved security in the connection compared to a two-point system. The fastening devices 201-1, 201-2, and 201-3 are not disposed in a line but rather spread out in a Y-shape at the front. For this purpose, the fastening devices 201-2 and 201-3 are located on laterally protruding trapezoidal wing portions 205 of the rail 200. The fastening device 201-1 is in particular disposed higher than the fastening devices 201-2 and 201-3.

The rail 200 comprises a channel 203 with a U-shaped profile in which the wheels 207 are disposed. The fastening device 201-1 is disposed in particular above the middle of the channel 203. The axle of the wheels 207 is inserted into the openings 211. Additional struts or bridges can be disposed in the middle of the channel 203 between the individual wheels 207 and between the side walls 215 to reinforce the rail 200.

The channel 203 in the rail 200 renders it possible to make the rail 200 shallower in order to lower the centre of gravity. In this way, rails 200 can be developed which are provided with larger wheel diameters and yet do not have a higher centre of gravity.

A user can move faster with larger wheels 207 without having to take account of disadvantages in the standing height with respect to comparable models with smaller wheels. By reason of the low centre of gravity, less static effort is required of the user and so he tires less quickly. In addition, the skater can maintain static and dynamic loads longer at a high level.

For example, in a free skate as a roller skate system 300 which is fitted with an asymmetrical three-point rail and four wheels with a diameter of 80 mm, the centre of gravity can be lowered by up to 15 mm compared to a free skate which is fitted with a conventional two-point mounting system with a mounting distance of 165 mm for the same wheel size. This allows the skater to arrive at the skater's end speed faster.

Figure 7:
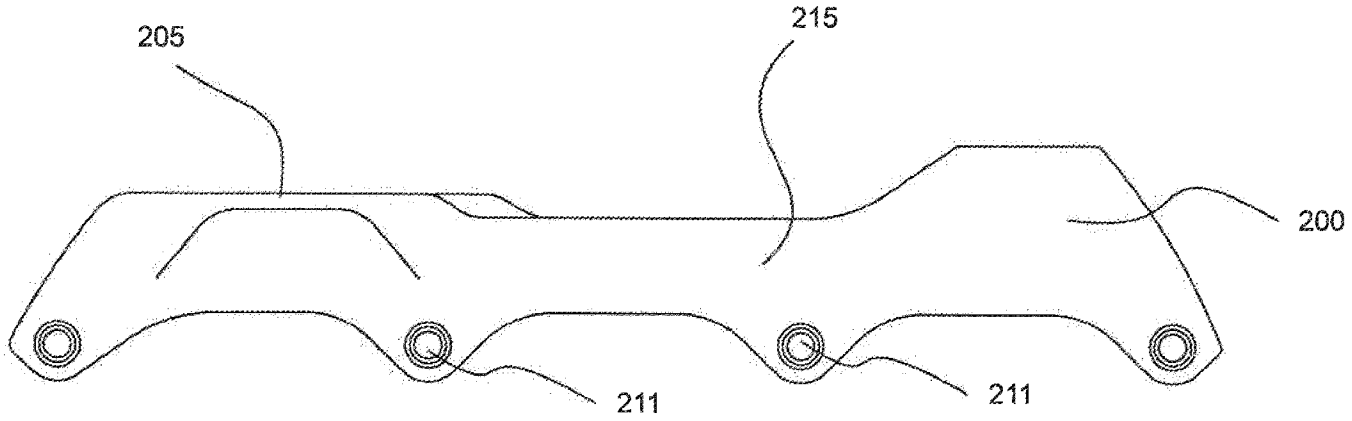
FIG. 7 shows a side view of the rail in FIG. 6.

FIG. 7 shows a side view of the rail 200. The rear fastening device 201-1 is located higher than the two front fastening devices 201-2 and 201-3. The two fastening devices 201-2 and 201-3 are disposed such that they lie below the uppermost point of a wheel 207. Therefore, the upper point of the wheel 207 in the region of the fastening devices 201-2 and 201-3 is higher than the contact surfaces 213. Therefore, the wheel 207 can be at least partially inserted between the wing portions 205 in the channel 203. The lowering of the two fastening devices 201-2 and 201-3 into the protruding wing portions 205 means that the centre of gravity of the roller skate system 300 can be lowered.

The three-point fastening system with the fastening devices 101 and 201 disposed in a triangle is advantageous from a technical point of view over a fastening system with three fastening points lying one behind the other because the two front fastening devices 101-2 and 101-3 are disposed laterally under the ball of the foot. A skater stands more securely in the roller skate system 300 and therefore the risk of accidents is reduced.

Since the rail 200 is mounted in the roller skate system 300 with three screw connections, different wheel set-ups can be tested or ridden quickly and easily without having to get used to new boots 100. In addition, in the event of a fault, the components of the roller skate system 300, such as, for example, the boot 100 or the rail 200, can be changed quickly and easily by loosening just three fastening screws.

In the case of the exemplary embodiment of the rail 200 as a 3-wheel set-up, the agility of the skater is improved because the skate is lighter and, in addition, the middle wheel serves as a centre of rotation. The roller skate system 300 can be configured for speed skating, in-line roller hockey, free skating or fitness skating.

All features explained and illustrated in conjunction with exemplary embodiments of the invention can be provided in different combinations in the subject matter in accordance with the invention in order to achieve the advantageous effects thereof at the same time.

The scope of protection of the present invention is set by the claims and is not limited by the features explained in the description or shown in the figures.

The term "comprising" (and its grammatical variations) as used herein is used in the inclusive sense of "having" or "including" and not in the exclusive sense of "consisting only of." The terms "a" and "the" as used herein are understood to encompass the plural as well as the singular.

All publications, patents and patent applications cited in this specification are herein incorporated by reference, and for any and all purposes, as if each individual publication, patent or patent application were specifically and individually indicated to be incorporated by reference. In the case of inconsistencies, the present disclosure will prevail.

The invention claimed is:

1. A boot for a roller skate system having a three-point fastening system for fastening the boot to a rail, the boot comprising:

a first fastening device being disposed centrally in a heel region of the boot;

a second fastening device being disposed on an outer side of a ball region of the boot; and a third fastening device being disposed on an inner side of the ball region of the boot, wherein the boot only includes the first fastening device, the second fastening device, and the third fastening device to fasten the boot to the rail, and wherein the second fastening device is disposed offset in a longitudinal direction of the boot with respect to the third fastening device.

2. The boot as claimed in claim 1, wherein the second fastening device is disposed offset in the longitudinal direction of the boot towards the first fastening device.

3. The boot as claimed in claim 1, wherein at least one of the first fastening device, the second fastening device, or the third fastening device includes an opening with an elongate cross-section for displacement of an inserted fastening screw.

4. The boot as claimed in claim 1, wherein the boot includes a hard shell in which the fastening devices are formed.

5. The boot as claimed in claim 4, wherein the hard shell is reinforced with carbon fibres, glass fibres or carbon fibres and glass fibres.

6. The boot as claimed in claim 1, wherein the first, second, and third fastening devices are formed as openings in a metal plate.

7. The boot as claimed in claim 1, wherein the first, second, and third fastening devices are surrounded by a planar contact surface.

8. A rail for a roller skate system having a channel for receiving a plurality of wheels disposed one behind another and a three-point fastening system for fastening the rail to a boot, the rail comprising:

a first fastening device being disposed above a middle of the channel;

a second fastening device being disposed laterally towards a side of the channel; and a third fastening device being disposed laterally towards another side of the channel, wherein the rail only includes the first fastening device, the second fastening device, and the third fastening device to fasten the rail to the boot, and wherein the second fastening device is disposed offset in a longitudinal direction of the rail with respect to the third fastening device.

9. The rail as claimed in claim 8, wherein at least one of the second fastening device or the third fastening device is disposed on a wing portion that protrudes laterally with respect to the channel.

10. The rail as claimed in claim 9, having a plurality of wing portions that are connected to one another beyond the channel.

11. The rail as claimed in claim 9, wherein the wing portions are trapezoidal, rectangular or semi-circular.

12. The rail as claimed in claim 8, wherein the second fastening device is disposed offset in a longitudinal direction of the channel towards the third fastening device.

13. The rail as claimed in claim 9, wherein at least one of the first fastening device, the second fastening device, or the third fastening device includes an opening with an elongate cross-section for displacement of an inserted fastening screw.

14. A roller skate system having a three-point fastening system for fastening a boot to a rail, the system comprising:

a boot including:

a first boot-fastening device being disposed centrally in a heel region of the boot;

a second boot-fastening device being disposed on an outer side of a ball region of the boot; and a third boot-fastening device being disposed on an inner side of the ball region of the boot, wherein the boot only includes the first boot-fastening device, the second boot-fastening device, and the third boot-fastening device to fasten the boot to the rail, and wherein the second fastening device is disposed offset in a longitudinal direction of the boot with respect to the third fastening device; and the rail as claimed in claim 8.

15. A roller skate system having a three-point fastening system for fastening a boot to a rail, the system comprising:

the boot as claimed in claim 1, and a rail having a channel for receiving a plurality of wheels disposed one behind another and a three-point fastening system for fastening the rail to the boot, the rail including:

a first rail-fastening device being disposed above a middle of the channel;

a second rail-fastening device being disposed laterally towards a side of the channel; and a third rail-fastening device being disposed laterally towards another side of the channel, wherein the rail only includes the first rail-fastening device, the second rail-fastening device, and the third rail-fastening device to fasten the boot to the rail, and wherein the second fastening device is disposed offset in a longitudinal direction of the rail with respect to the third fastening device.

* * * * *